United States Patent [19]

English

[11] 4,352,964

[45] Oct. 5, 1982

[54] SLIDE AND ROCKER SWITCH ASSEMBLIES HAVING DOUBLE CANTILEVERED CONTACTOR

[75] Inventor: Jack A. English, Elkhart, Ind.

[73] Assignee: CTS Corporation, Elkhart, Ind.

[21] Appl. No.: 247,409

[22] Filed: Mar. 25, 1981

[51] Int. Cl.[3] ..... H01H 3/00

[52] U.S. Cl. ..... 200/5 A; 29/622; 200/6 R; 200/16 R; 200/339

[58] Field of Search ..... 200/6 R, 6 C, 16 R, 200/16 A, 16 C, 16 D, 5 A, 252, 339, 335, 67 R, 291, 257, 260

[56] References Cited

U.S. PATENT DOCUMENTS

| | | | |
|---|---|---|---|
| 3,846,596 | 11/1974 | Wolf | 200/16 D |
| 3,883,705 | 5/1975 | Sebastian et al. | 200/6 B |
| 3,958,090 | 5/1976 | Garcia | 200/67 AA |
| 3,965,319 | 6/1976 | Lockard | 200/310 |
| 3,974,346 | 8/1976 | Kepuda | 200/5 B |
| 3,978,298 | 8/1976 | Fukuda et al. | 200/6 R |
| 4,012,608 | 3/1977 | Lockard | 200/16 D |
| 4,072,834 | 2/1978 | Frederick et al. | 200/16 C |
| 4,092,504 | 5/1978 | Kotaka | 200/16 D |
| 4,095,060 | 6/1978 | Kepuda | 200/16 D |
| 4,095,071 | 6/1978 | Chamberlain | 200/157 |
| 4,117,280 | 9/1978 | Feaster | 200/6 B |
| 4,128,745 | 12/1978 | Marsilio et al. | 200/16 C |
| 4,168,404 | 9/1979 | Lockard | 200/1 R |
| 4,191,867 | 3/1980 | Feaster | 200/16 R |
| 4,311,884 | 1/1982 | Henley et al. | 200/16 R |

FOREIGN PATENT DOCUMENTS

| | | |
|---|---|---|
| 228981 | 7/1960 | Australia . |
| 2524287 | 11/1975 | Fed. Rep. of Germany . |
| 2442476 | 3/1976 | Fed. Rep. of Germany . |
| 2539581 | 1/1977 | Fed. Rep. of Germany . |
| 2716491 | 3/1977 | Fed. Rep. of Germany . |
| 2335932 | 7/1977 | France . |
| 925257 | 5/1963 | United Kingdom . |

*Primary Examiner*—A. T. Grimley
*Assistant Examiner*—Morris Ginsburg
*Attorney, Agent, or Firm*—Larry J. Palguta; John A. Young

[57] ABSTRACT

A miniature insert molded slide (10) or rocker (12) switch assembly is designed for machine insertion on printed circuit boards. A metallic strip (90) is blanked to form pairs of oppositely disposed terminals (22) still attached to the carrier strip (92). The insert-molding operation forms a box-like housing (14) about the terminals (22) on the strip (90), each pair of terminals (22) being embedded in the base (16) of said housing (14). During the insert-molding operation, the die forms the terminal head (28) of each terminal (22). The housing-terminals construction is utilized for both the slide (10) and rocker (12) switch assemblies. The slide switch assembly (10) includes an actuator (40) having a double cantilevered resilient contactor (50) entrapped in a through opening (48) in the actuator (40), the contactor (50) having a depending arcuately shaped contactor head (54) for engaging and disengaging the terminal heads (28). The rocker switch assembly (12) includes an actuator (60) having a through opening (66) and double cantilevered contactor (50) and has upward angled extensions (64) and lateral projections (70) from the sides of the actuator (60). The lateral projections (70) comprise pie-shaped shafts (70), the bottom portion (72) being arcuately shaped for slideable engagement with the top of transverse housing walls (19), and the point comprising a pivot (74).

10 Claims, 6 Drawing Figures

2/2

SLIDE AND ROCKER SWITCH ASSEMBLIES HAVING DOUBLE CANTILEVERED CONTACTOR

DESCRIPTION

TECHNICAL FIELD

The switch assemblies of this invention relate to dual in-line-pole (DIP) switches for use with printed circuit boards and may be miniature in size.

BACKGROUND ART

The electronics industry has a need for miniaturized dual-in-line-pole switches which may be utilized with printed circuit boards for the opening and closing of circuits thereon. A number of switches are available on the market, but many are of a size not adapted for automatic machine insertion on a printed circuit board. The further miniaturization of switches to a size susceptible to automatic machine insertion creates a number of problems which must be overcome. It is preferrable that the switch assembly require as few steps as possible and provide a structually strong and reliable construction. In this respect, it is important that the switch be water tight since switches are usually secured to PC boards by the use of wave-soldering techniques which permit a flux residue infiltration in the switch if the parts are not tight fitting. As few manufacturing steps as possible are desireable so that the possibility of damage to the piece parts is minimized and the quality of the product improved.

The Kotaka U.S. Pat. No. 4,092,504, issued May 30, 1979 illustrates a miniature switch package which requires a number of manufacturing steps and includes the problems inherent with a multiple piece part assembly. The switch of the Kotaka patent requires that the terminal be fully formed during the metal strip blanking operation, and then the terminals are inserted into a multichanneled base member and the terminal legs bent downwardly before a housing is secured thereover. It would be preferrable that the terminals be formed when they are tightly secured in order to provide a very finite positioning of each terminal in relation to the oppositely disposed terminal. Zdanys et al. U.S. Pat. No. 3,944,760 issued Mar. 16, 1976, and assigned to the same assignee as herein, illustrates a switch package which is not small enough to be machine insertable, and which utilizes single cantilevered terminal arms that are insert molded in separate halves of the base. It would be advantageous if the switch assembly can be utilized both for slide switch assemblies and rocker switch assemblies, which neither of the aforementioned patents describe.

The miniature switch assembly of the present invention solves the above-described problems by providing a miniature switch assembly wherein the basic parts can be utilized for either a slide switch assembly or a rocker switch assembly. The difference between the two assemblies is that a different actuator and cover is utilized for the rocker switch assembly. The miniature switch assembly is small enough to be inserted by automatic machinery on a PC board, has a water tight housing to prevent the entry of flux residue during wave solder operations, enables the forming of terminals to establish finite positioning of the two oppositely disposed terminals, utilizes a double cantilevered contactor to minimize contactor fatigue, and provides an actuator-contactor assembly suitable for automatic assembly and bulk handling.

DISCLOSURE OF THE INVENTION

The miniature switch assembly comprises a box-like insulative housing insert-molded about sets of oppositely disposed terminals formed from a previously blanked metal strip. When the box-like housing is insert molded about the plurality of terminals, the die forms the terminal heads while the terminals are tightly held in position within the mold die, and then the insert molding operation is completed. Each terminal has its upper surface flush with the adjoining insulative material of the base of the housing and extends laterally outside of the housing to the metal strip carrier. The housing contains a plurality of separate chambers formed by the side walls of the box-like housing and a plurality of walls extending transversely across the base. Disposed within each chamber is an actuator-contactor assembly. The actuator comprises an insulative material including an upwardly extending projection and a longitudinal opening extending through the actuator body. At one end of the opening is a downwardly extending abutment. The contactor comprises a double cantilevered contactor including a first portion that is reversely bent and having at the one end a downwardly depending arcuate contactor head. The contactor is automatically inserted into the longitudinal opening, and the other end of the contactor abuts the actuator abutment to secure the contactor within the actuator for movement therewith. The actuator-contactor assembly is positioned one within each chamber, and then a cover, having a plurality of apertures for actuator projections to extend therethrough, is positioned over the actuator-contactor-housing subassembly and secured to the open end of the housing by heat staking. Lateral movement of the actuator accomplishes engagement and disengagement of the contactor head with the subjacent terminal heads. The rocker actuator comprises an insulative member having a longitudinal opening therethrough and either angled projections or a post extending from the top portion thereof. The actuator has a downwardly projecting abutment and outwardly extending stop, the contactor being positioned in the through longitudinal opening so that one end of the contactor is secured by the abutment. The actuator has pie-shaped lateral projections, the arcuate portions of the lateral projections resting upon the top of the lateral walls of the housing when the actuator-contactor subassembly is placed in the housing chamber. A cover having a plurality of apertures and transverse depending walls is placed over the open end of the housing. Each transverse depending wall has a notched opening for receiving the top portion of the pie-shaped lateral projections. The openings of the transverse depending walls secure the lateral projections of the rocker actuators to the top of the lateral walls so that when the rocker actuator is rotated by pivoting the actuator about the pivot point of the pie-shaped lateral projections, the arcuate portion of the projections slideably engages the top of the transverse housing walls.

The miniature switch assembly is suitable for automatic machine insertion onto printed circuit boards. The box-like housing, insert-molded about the terminals, provides a construction that will not allow the entry of flux or other contaminants into the interior of the switch package. The holes in the base which are the result of the mold die being utilized to form the terminal heads during the insert-molding operation, may be sealed if so desired. Because the terminal heads are formed during the molding operation, each terminal is tightly held within the die during the forming and this eliminates any improper bending of the terminals causing the terminal heads to be improperly positioned in relation to each other. Additionally, the top surface of each terminal is flush with the top surface of the base, and this embedding of the terminal structure within the base of the insulative housing provides further strengthening and reliability to the switch assembly. The small size of the switch makes it difficult to use a single cantilever type of contactor structure. Thus, the use of a double cantilever type contactor not only serves to provide a means for securing the contactor within the actuator, but halves the internal stresses of the contactor. This will prolong the wear life of the contactor and will provide the necessary resilience for such a contactor. Finally, the actuator and contactor subassembly is susceptible to automatic assembly and allows the subassembly, whether for a slide switch or a rocker switch, to be bulk handled without the parts coming apart, or any bending or damaging of the contactors. Once the subassembly is effected, the only exposed portion of the contactor is the arcuate head.

Another substantial advantage of the present invention is the design flexibility which allows the assembly of both miniature slide and rocker switch assemblies with only two different parts being utilized for the different constructions. If a rocker switch assembly is desired, then all that need be used is a rocker actuator and an insulative housing cover having the transverse depending walls with notches therein. The housing-terminal subassembly is utilized for both constructions.

Most significant is the substantial decrease in the number of manufacturing steps. The miniature switch assembly may be assembled by simply blanking the terminal carrier strip, insert-molding the housing thereabout, forming the contactors and automatically inserting them into actuators, positioning the actuator-contactor subassemblies within the chambers of the housing, and then securing the appropriate cover to the open end of the housing and trimming the carrier strip. This assembly lends itself to the utilization of a minimum number of assembly steps, protection of the various piece parts utilized therein, and the attainment of close tolerances and positioning dimensions.

BEST MODE FOR CARRYING OUT THE INVENTION

Figure 1B:
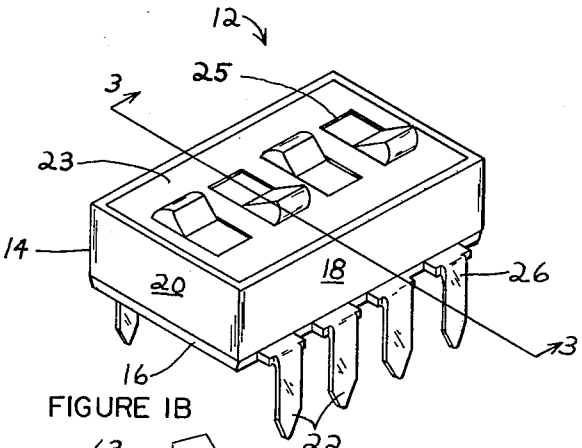
FIGS. 1A and 1B are isometric views of the miniature slide switch and rocker switch assemblies.
Figure 1A:
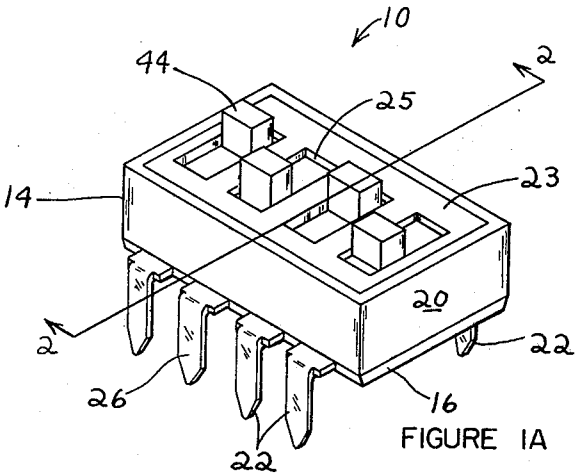
Figure 2:
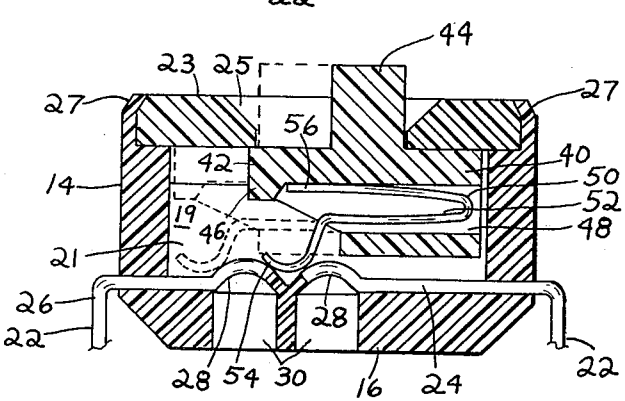
FIG. 2 is a section view of the miniature slide switch assembly of FIG. 1A.

Referring now to the drawings, particularly FIGS. 1-2, the machine insertable miniature slide switch assembly is designated generally by reference numeral 10, and the rocker switch assembly is designated generally by reference numeral 12. Slide switch assembly 10 comprises a box-like housing 14 having a base 16, side walls 18, end walls 20, and transverse housing walls 19. The walls 18, 19, and 20 form chambers 21. The housing 14 is insert-molded about a plurality of oppositely disposed terminals 22. Terminals 22 each consist of a longitudinal portion 24 embedded within the base and wall of the housing 14, and an exterior downwardly bent portion 26. Each terminal 22 has a dome shaped terminal head 28, the perimeter thereof embedded in the base 16. Each of the terminal heads of the oppositely disposed terminals 22 are disposed over an aperture 30 located in the base 16. The aperture 30 is formed as a result of the combined forming and insert-molding operation wherein the mold die forms the terminal heads when the die closes and then the insert molding operation is completed.

The slide switch actuator 40 is comprised of a body 42, an upwardly extending projection 44, and an abutment 46. A longitudinal opening 48 passes through the length of the actuator 40, with the abutment 46 partially enclosing one end thereof.

A double cantilevered metallic contactor 50 is comprised of a reversely bent arm 52 having at one end, and integral therewith, an arcuately shaped contactor head 54. The double cantilevered contactor 50 is positioned within the longitudinal opening 48 of the actuator 40 such that end 56 of the contactor abuts against the actuator abutment 46. The contact between the end 56 and the abutment 46 secures the contactor within the longitudinal opening such that the only exposed portion of the contactor 50 is the arcuate contactor head 54. The actuator-contactor subassembly is positioned within a chamber 21 formed within the housing 14, so that the contactor head 54 is disposed between and contacts the terminal heads 28. Cover 23 having a plurality of apertures 25 is then placed over the open end of the housing 14, the projection 44 extending through its respective aperture 25. The cover 23 is secured to the housing by heat staking the perimeter flanges 27 about the perimeter of the cover 23.

Each actuator-contactor assembly is now positioned within its associated chamber 21, the resiliency of the contactor 50 biasing the actuator 40 into contact with the cover 23. Lateral movement of the actuator displaces the actuator to slideably disengage the contactor head 54 from one of the terminal heads 28 as illustrated by the dotted line drawing. Moving the actuator laterally back to the initial position will effect reengagement of the contactor head 54 with both terminal heads 28.

The slide switch assembly 10 had been constructed with a minimum number of manufacturing steps that lend themselves to very close control of dimensional tolerances, and securement of the individual parts so that the chance of damage to the parts is minimized. The actuator-contactor subassembly lends itself to automated assembly and bulk handling. Additionally, the wear life of the contactor is enhanced because of the minimizing of internal stresses upon the double cantilevered design.

The miniature insert-molded rocker switch assembly 12 (FIG. 1B) may be constructed from the same parts described above with the only different parts being an actuator 60 and cover 80. The box-like housing 14 and terminals 22, and the process for manufacturing these parts, are the same as described above. The rocker switch actuator 60 comprises an actuator body 62 having angled upward extensions 64, longitudinal through opening 66, and a lateral extension 68 which serves as an abutment. Additionally, projecting laterally from each side of the actuator 60 is a pie-shaped shaft 70 having an arcuate bottom 72 and pivot 74. Again, the contactor 50 may be machine inserted into the longitudinal opening 66 as previously described for the slide switch actuator-contactor subassembly. The end 56 of the contactor 50 abuts the abutment and lateral extension 68, which secures the contactor within the longitudinal opening 66. The actuator-contactor subassembly is positioned within a respective chamber 21 so that each arcuate bottom 72 rests upon the top of a transverse housing wall 19.

Figure 3:
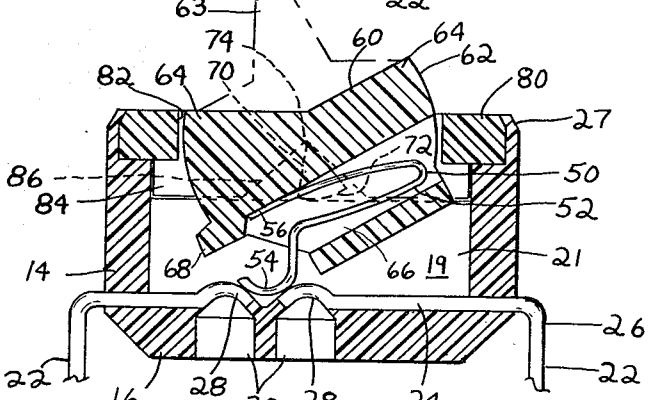
FIG. 3 is a section view of the miniature rocker switch assembly of FIG. 1B in "closed" position.
Figures 4, 5:
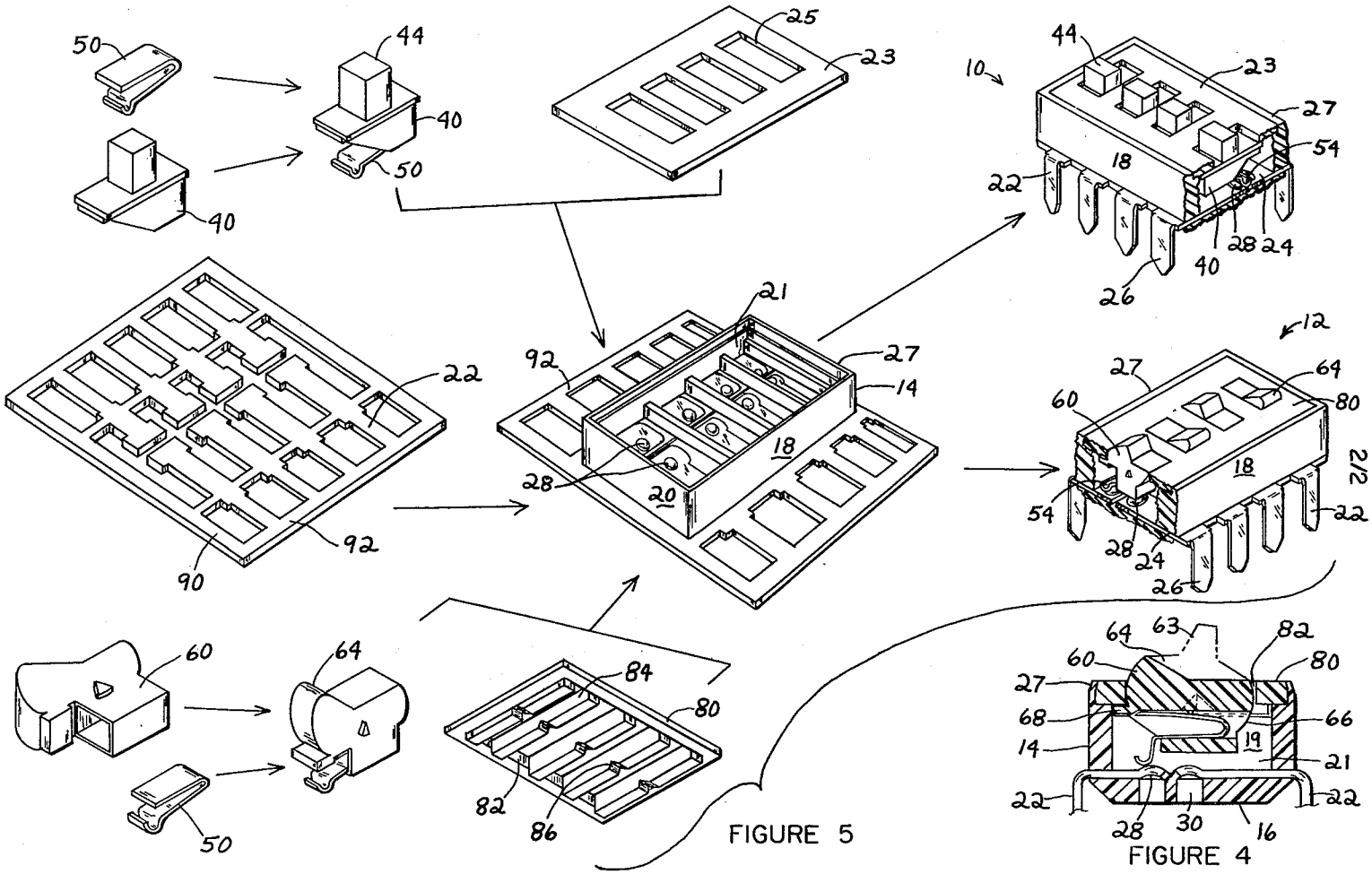
FIG. 4 is a section view of the miniature rocker switch assembly of FIG. 3 in the "open" switch position.
FIG. 5 is an illustration showing the miniature slide and rocker switch components at various stages of assembly with the arrows illustrating the progression of assembly.

Housing cover 80 having depending transverse walls 84 with notched openings 86 is then positioned over the top of housing 14. The notch 86 receives the pivot 74 to secure the actuator 60 within the chamber, and when the actuator is rotated, the arcuate bottom 72 slideably engages the top of wall 19 as the actuator pivots about pivot 74, with the contactor head 54 engaging and disengaging the terminals heads 28 as shown in FIGS. 3 and 4. To limit the rotation of the actuator 60, lateral extension and abutment 68 engages the bottom surface of cover 80. Cover 80 is secured to the housing 14 by heat staking the perimeter flanges 27 over the perimeter of the cover 80.

As shown in FIGS. 3 and 4, the actuator 60 may also be designed to have projection 63 extend through cover aperture 82 for rotatable control of the actuator.

As can readily be seen from the description of the slide and rocker switch assemblies, the switch is of a facile and straight forward design which lends itself to utilization of most of the components for both switch constructions. Only a different actuator and cover need be installed in order to assemble a rocker switch. The housing 14 is molded about the terminals 22, which results in the longutudinal portions 24 being embedded within the base and walls of the housing. This securement of the interior portions of the terminals allows for much greater control of the dimensional and operational tolerances of the switch components, particularly when the terminal heads 28 are formed during the insert-molding operation.

ASSEMBLY AND OPERATION

Referring now to FIG. 5, illustrated therein are the assembly steps for manufacturing both the miniature machine insertable slide and rocker switch assemblies 10 and 12, respectively. Metal strip 90 is blanked to form carrier strip 92 and laterally extending terminals 22. The carrier strip 92 is positioned within the die of an insert-molding machine (not shown). When the die of the insert molding machine is closed, the terminal heads 28 are formed and thermoplastic material insert-molded thereabout to form housing 14. The housing 14 continues to be transported by the carrier strip 92 as the housing-terminal subassembly proceeds through the following steps.

Contactors 50 are automatically inserted into either slide switch actuators 40 or rocker switch actuators 60. Then the appropriate actuator-contactor subassemblies are positioned within housing chambers 21 and the corresponding cover positioned over the housing-terminal and actuator-contactor subassemblies. For the slide switch assembly, a cover 23 is positioned within perimeter flanges 27 of housing 14, the projections 44 extending through the apertures 25. The cover 23 is secured to the housing 14 by heat staking of the flanges 27 about the perimeter of the cover 23. Likewise, the insulative cover 80 is positioned over a housing-terminal and rocker actuator-contactor subassembly to enclose the open end of the housing 14. The transverse walls 84 of the cover 80 mate with the tops of the transverse walls 19 so that the notches 86 trap the lateral shafts 70 therebetween. The angled extensions 64 of the rocker actuators 60 extend through cover apertures 82 for operation of the switch. The cover 80 is then secured to the housing 14 by heat staking the perimeter flanges 27 about the perimeter of the cover 80.

Both of the switch assemblies then proceed through the final step of construction wherein a die (not shown) forms the terminals and trims the metal carrier 92. The terminals are bent downwardly to form terminal portions 26, and the carrier strip 92 and portions of the carrier disposed between the terminals and adjacent to the housing walls 18 are trimmed away.

The slide switch assembly is operated by pushing the projection 44 laterally so that the contactor head 54 wipingly engages or disengages the terminal heads 28, depending upon the initial position of the actuator 40. This produces a positive "feel" as the contactor is displaced slightly upwardly as the head slides over a terminal head 28. The resilience of the contactor 50 biases the actuator 40 against the underside of the cover 23. The housing remains sealed so that solder, dust, and other contaminants will not enter into the interior of the switch housing.

The rocker switch assembly is actuated by pushing downwardly on the angled extension 64 that projects above the top surface of the cover 80, thereby causing the actuator to rotate about pivot 74 and the arcuate bottom 72 to slide over the top of the transverse wall 19, the contactor head 54 slideably engaging or disengaging the terminal heads 28, depending upon the initial position of the actuator 60. If the actuator is rotated to an "open" switch position, the contactor head 54 slides over the left terminal head 28 in FIG. 4, and the lateral projection 68 engages the bottom surface of the cover 80 to limit further rotation thereof. Moving the switch to an "on" switch position, entails pushing an angled extension 64 downward to rotate the actuator and slide the contactor head 54 over the left terminal head 28 in FIG. 4 to a position intermediate of and in contact with both terminal heads 28, as shown in FIG. 3.

The miniature machine insertable slide and rocker switch assemblies include a design which lends itself to automated mass manufacturing of the switch parts and automated assembly. The reduced number of steps in the manufacturing method produces closer control of dimensional tolerances and operating characteristics of the parts of the switch assembly, and allows the manufacturer to utilize the basic parts of the assembly for either type of switch construction. These switch designs have solved the above-described problems inherent in the construction of a miniature switch suitable for machine insertion onto a printed circuit board. With the new emphasis on quality control standards in order to compete with off-shore manufacturers, the slide and rocker switch assemblies lend themselves readily to complete automated processing from the initial forming steps to the final switch assembly. Thus, there are substantial savings in labor and machinery costs, and the improvement in quality control will minimize the scrapage of parts and the return of defective switch assemblies.

INDUSTRIAL APPLICABILITY

The present invention may be used in conjunction with printed circuit board applications wherein a miniature switch may be machine inserted onto the circuit board and wave soldered thereto.

CONCLUSION

Although the present invention has been illustrated and described in connection with example embodiments, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

I claim:

1. A miniature slide switch assembly comprising a box-like housing having a base, side walls, and a plurality of transversely extending walls forming individual chambers therein, a plurality of apertures extending between the upper and lower surfaces of said base and communicating with said chambers, a plurality of terminals secured to said base, said terminals disposed in pairs of oppositely disposed terminals with one pair in each of said chambers, each of said oppositely disposed terminals including an arcuate shaped terminal head disposed over one of said apertures and a longitudinal portion embedded in the upper surface of said base and extending outwardly of said housing, a plurality of actuators each disposed in one of said chambers and including an upwardly extending post and a longitudinal passage formed in the subsurface of said actuator, a plurality of double cantilevered contactors each comprising a reversely bent contactor arm integral with an arcuately shaped contactor head, each of said contactors having its reversely bent contactor arm disposed in a respective one of said passages to fixedly secure the contactor within a respective actuator, and a cover having a plurality of apertures therein, each of said posts projecting through a cover aperture for actuation of the respective slide switch.

2. The slide switch assembly of claim 1, further comprising housing perimeter flange extensions, said flange extensions formed over the perimeter of said cover to secure the cover to said housing.

3. The slide switch of claim 1, wherein the upper surface of the base of the housing is flush with the upper surfaces of the longitudinal portions.

4. The slide switch assembly of claim 1, wherein the actuator includes a projection partially closing one end of said passage and an end of said reversely bent contactor arm abutting said projection to secure said double cantilevered contactor to said actuator for movement therewith.

5. A miniature rocker switch comprising a box-like housing comprising a base having an upper surface and a lower surface and upwardly extending walls about the perimeter of said base and a plurality of transversely extending walls forming chambers therein, said base having a plurality of apertures communicating with the upper and lower surfaces of the base at a respective chamber, a plurality of oppositely disposed terminals, each terminal embedded in said base and having a longitudinal portion and at end thereof a dome-shaped terminal head disposed over one of said apertures and another end of the terminal extending outwardly of said housing to form a second portion, a plurality of actuators each having an upward extension, a longitudinal passage at the undersurface therein extending through the actuator, transverse projections each having an arcuate portion extending from a respective side of said actuator, each of said actuators disposed in one of said chambers with the arcuate portion of each of said transverse projections resting upon a transversely extending wall thereof for slideable engagement therewith, a double cantilevered arm comprising a reversely bent first portion integral with a downwardly extending arcuate portion, said reversely bent first portion disposed in said passage to fixedly secure the arm within a respective actuator, and a switch cover having a plurality of apertures for receiving upward extensions therein and a plurality of transverse walls each having a cut-away portion for securing said transverse projections, said transverse projections received in said cut-away portions such that rotation of said actuator produces slideable engagement of said arcuate portions with the respective transversly extending walls to effect slideable engagement and disengagement of said downwardly extending arcuate portion with said oppositely disposed dome-shaped terminal heads.

6. The miniature rocker switch of claim 5, wherein said transverse projections comprise wedge-shaped lateral projections having an arcuate portion at the bottom thereof and terminating in a pivot point received in said cut-away portion.

7. The miniature rocker switch of claim 5, wherein said actuator further comprises a downward and outward projection partially closing one end of said passage, said downward portion forming an abutment for engagement with an end of said first portion to secure said arm to said actuator for movement therewith, and said outward projection comprising a stop arm for limiting rotational movement of said actuator.

8. The miniature rocker switch of claim 5, further comprising perimeter extensions on said walls about the perimeter of the base and formed over the perimeter of said cover to secure said cover to the housing.

9. The miniature rocker switch of claim 5, wherein each upward extension comprises a grip projection extending from said actuator and through the respective cover aperture for actuation of said actuator.

10. The miniature rocker switch of claim 5, wherein the upper surface of said base is flush with the upper surface of said longitudinal portions.

* * * * *